US011167197B2

(12) United States Patent
Kleva

(10) Patent No.: US 11,167,197 B2
(45) Date of Patent: Nov. 9, 2021

(54) METHOD AND APPARATUS FOR EXCHANGING BARBELL WEIGHT PLATES USING A HANDHELD BARBELL JACK TOOL

(71) Applicant: Steven Kleva, Tempe, AZ (US)

(72) Inventor: Steven Kleva, Tempe, AZ (US)

( * ) Notice: Subject to any disclaimer, the term of this patent is extended or adjusted under 35 U.S.C. 154(b) by 0 days.

(21) Appl. No.: 16/750,760

(22) Filed: Jan. 23, 2020

(65) Prior Publication Data

US 2021/0228966 A1 Jul. 29, 2021

(51) Int. Cl.
*A63B 71/00* (2006.01)
*A63B 21/072* (2006.01)

(52) U.S. Cl.
CPC ..... *A63B 71/0036* (2013.01); *A63B 21/0724* (2013.01)

(58) Field of Classification Search
CPC . A63B 71/0036; A63B 21/075; A63B 21/078; A63B 21/0722; A63B 21/072; A63B 21/4035; A63B 21/0724; Y10T 29/49815
See application file for complete search history.

(56) References Cited

U.S. PATENT DOCUMENTS

2002/0121765 A1* 9/2002 Wolf ..... A63B 22/0017 280/609
2011/0183818 A1* 7/2011 Mitchell ..... A63B 71/0036 482/104
2015/0157894 A1* 6/2015 Rulli ..... A63B 21/078 482/104

OTHER PUBLICATIONS https://www.facebook.com/InnerStrengthProducts/videos/baltic-jack-story-video-3/661705100987618/; Posted Oct. 19, 2019; Inner Strength Products.*
https://www.youtube.com/watch?v=TShXyY6ZtdU; Posted Dec. 23, 2017; Basement Brandon.*
https://www.amazon.com/Yes4All-Mini-Deadlift-Barbell-Handle/dp/B07H3R8F5S/ref=sr_1_5?dchild=1&keywords=deadlift%2Bjack&qid=1622736851&sr=8-5&th=1; Posted Nov. 4, 2020; Yes4All.*

* cited by examiner

*Primary Examiner* — Nyca T Nguyen
*Assistant Examiner* — Andrew M Kobylarz

(57) ABSTRACT

A method and apparatus for exchanging barbell weight plates using a hand held jack tool is disclosed. The invention being comprised of a rectangular-shaped, rigid metal plate device having a supported slot along the center and a cam-shaped foot base. Said supported slot having a width to receive a barbell. The device also having an end with a grip-contoured profile. The method being comprised of installing said slot of the invention on an under side of a barbell proximal to its center but near its weighted end, rocking said device back onto its foot (lifting said barbell and weights) until stationary and allowing a user to safely slide plates on and off said barbell without touching the floor. An object of the invention is to allow weight lifters to exchange weight plates while a barbell is resting on the floor.

3 Claims, 3 Drawing Sheets

SECTION A-A

METHOD AND APPARATUS FOR EXCHANGING BARBELL WEIGHT PLATES USING A HANDHELD BARBELL JACK TOOL

FIELD OF THE INVENTION

The present invention generally relates to gym equipment. More specifically, the invention relates to barbell accessories.

BACKGROUND

The deadlift is a weight training exercise in which a loaded barbell, loaded with circular weight plates, is lifted off the floor (known as a dead weight) to a lifter's hips and then released to the floor once again. While warming up for such exercise, lifters start with lighter weights and work their way up to heavier plates. In order to replace such plates, the barbell needs to be hoisted up onto to a rack that allows them to slide on and off. With the growing popularity of home gyms, lifters often perform such lifting alone and changing weights can be difficult, and in some cases dangerous. In addition, not every lifter can afford a cradle rack systems to perform weight exchanges for deadlifting. The exercise industry has developed safer methods for performing weight plate exchanges independently. U.S. Patent No. 20110183818A1 granted to Mitchell & Jordan disclosed an apparatus that lifts an entire barbell with weights off a floor to replace said weights. Embodiments of the invention do not include handheld, portable tools. U.S. Pat. No. 8,926,481B2 granted to Moore disclosed a barbell jack stand comprised of a cam wheel with a slot that allows a barbell to be lifted and weights exchanged when said wheel is turned, although it is bulky in size. U.S. Patent No. 20150157894A1 granted to Wagner disclosed a barbell weight exchange device comprised of a small platform allowing a user to roll a barbell up to obtain proper elevation to exchange weights. However, the device does not include a grip handle for easy rolling of the barbell up and off the floor. While several barbell jacks were found in the prior art, none were found that included a hand grip or were lightweight and portable enough to fit into a backpack easily.

SUMMARY OF THE INVENTION

The device herein disclosed and described provides a solution to the shortcomings in the prior art through the disclosure of a method and device for replacing weight plates on a barbell. An object of the invention is to allow an individual to replace weight plates for a barbell that is resting on the floor unassisted. The invention is a barbell lifting tool that can be used by a single person to lift and hold one end of a loaded barbell off the ground to allow weights to slide on and off.

Another object of this invention is to provide an ergonomic means to easily lift one end of a loaded barbell off the floor. The top end of the tool is shaped in the form of a hand grip. The center of the tool contains a slot that allows the user to hook a standard barbell. The bottom of the tool has cam-shaped feet. These features allow an individual to quickly hook a barbell from the bottom and pull back on the tool's grip to engage the cam feet thereby elevating the barbell in a rolling motion. Once the barbell is lifted, the flat portion of the feet halt the pull and hold the barbell safely at an elevation that allows plates to be exchanged. The tool provides a fulcrum allowing an extremely heavy load to be raised off the floor with minimal pull.

Another object of this invention is to provide a means to safely hold one end of a loaded barbell off the floor indefinitely while a plate exchange is performed. The cam feet of the invention are comprised of several, equally-spaced plates held together by secure rods. The spacing allows the feet to hold a loaded barbell and prevent any lateral motion from taking place while under load.

Another object of this invention is to provide a means to prevent damage to a barbell during use. The engagement slot is lined with a plastic insert that prevents the metal portion of the invention from making contact with a barbell preventing any scratching.

Another object of this invention is to provide a portable barbell jack. Due to the small size and light weight of the invention, users can easily stow and transport the device in a backpack.

It is briefly noted that upon a reading this disclosure, those skilled in the art will recognize various means for carrying out these intended features of the invention. As such it is to be understood that other methods, applications and systems adapted to the task may be configured to carry out these features and are therefore considered to be within the scope and intent of the present invention, and are anticipated. With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention. As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

The objects features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF THE FIGURES

The accompanying drawings, which are incorporated herein and form a part of the specification, illustrate some, but not the only or exclusive, examples of embodiments and/or features.

Figure 4:
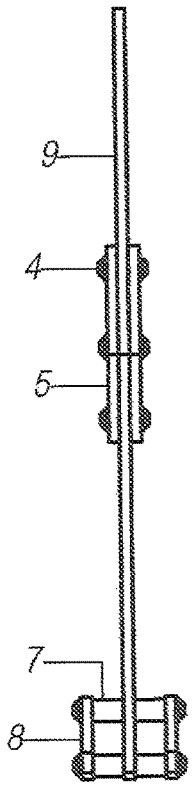
FIG. 4 showing a front view of the invention.

Other aspects of the present invention shall be more readily understood when considered in conjunction with the accompanying drawings, and the following detailed description, neither of which should be considered limiting.

DETAILED DESCRIPTION OF FIGURES

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 1:
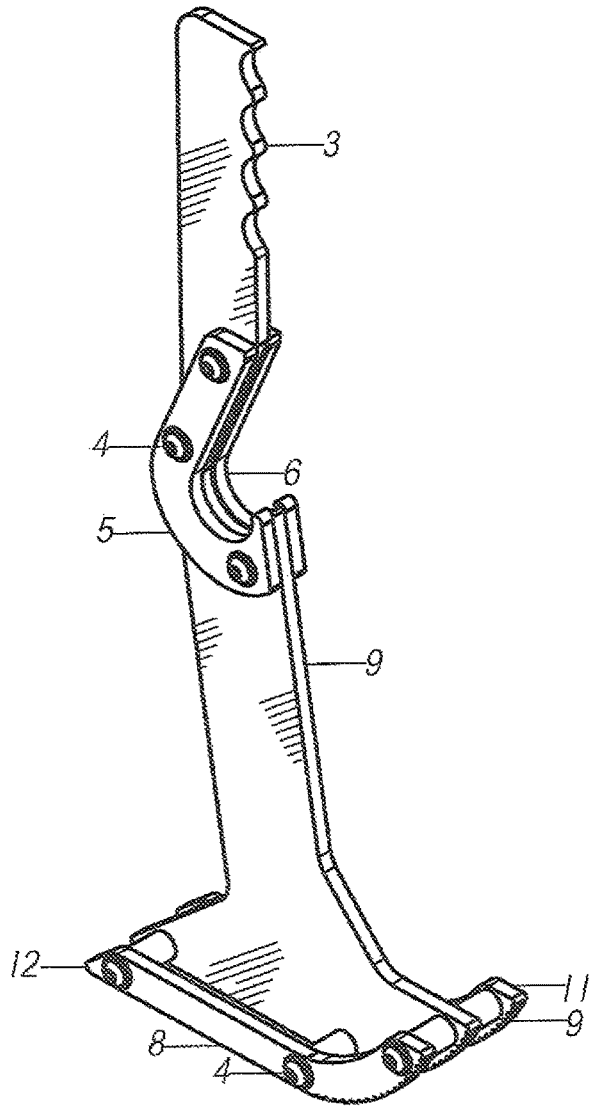
FIG. 1 showing a perspective view of the invention.

FIG. 1 showing a perspective view of the preferred embodiment of invention 1 having an overall planar, rectangular shaped main plate 9 and being made of a rigid material, such as but not limited to, aluminum, steel, titanium and the like. One end of invention 1 having a plurality of finger grips 3 on an edge with diameters to receive fingers and another end having a foot-shaped portion with teeth extending outward from the longitudinal axis of said main plate 9 with a plurality of orifices along its perimeter on a terminal end. Said main plate having an upturned, toe 11 extending from a foot portion 10 being slightly proximal to said main plate 9 than heel 12. Said foot 10 also having an upwardly-curved profile from its proximal terminus to the farthest end of said toe 11. Heel 12 having a triangular-shaped contour protrusion extending perpendicular away from said main plate 9 and having a flat bottom.

Figure 2:
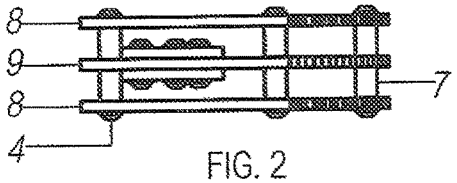
FIG. 2 showing a bottom view of the invention.

FIG. 2 showing a bottom view of invention 1 having at least two outrigger plates 8 disposed about each side of said main plate 9 and being configured at the end of said foot 10. Outrigger plates 8 being rectangular in shape on heel 12 end and a curve following said toe end 11 similar to said main plate 9. Said outrigger plates 8 being constructed of a rigid material such as, but not limited to, aluminum, steel etc. and having a plurality of apertures with distances matching apertures in main plate 9. Said outriggers 8 also being affixed to said main plate 9 by means of screw rods 4 that pass through apertures on both the main plate 9 and outriggers 8. The foot 10 and outriggers 8 having a notched or teeth outline on their terminal ends.

Figure 3:
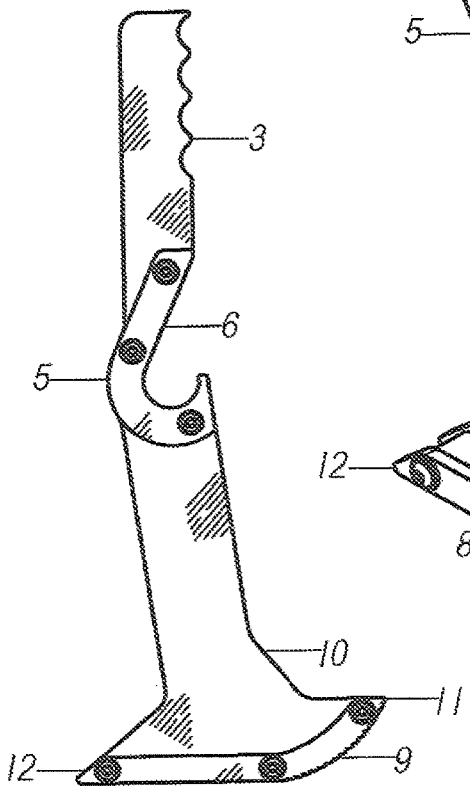
FIG. 3 showing a side view of the invention.

FIG. 3 showing a side view of the invention with slot 6 having a diameter slightly larger than the diameter of a standard barbell diameter. Said slot 6 being angled proximally inside said main plate 9 with a circular end therein.

FIG. 4 showing a front view of the invention illustrating at least two protectors 5 disposed on each side of main plate 9 around said slot 6 and having an a shape identical to slot 6. Protectors 5 being made of, but not limited to, a rigid plastic such as delrin and the like. Said protectors also being affixed to main plate 9 by means of said screw rods 4 adapted through apertures in both protectors 5 and main plate 9.

Figure 5:
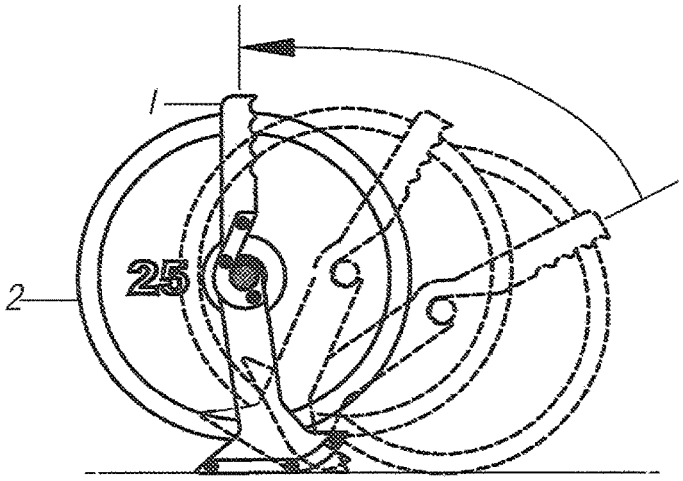
FIG. 5 showing a section view of a barbell with the invention being used.

FIG. 5 showing a section view of a barbell being lifted by invention 1. The method includes the following operations: the barbell 2 bar is inserted into slot 6 on main plate 9; finger grip 3 is pulled back allowing slot 6 to engage foot 10 on the floor; said load on invention 1 by the user causing barbell 2 to be pivotably raised on toe 11; and flat portion of said heel 12 halting rotational motion and supporting said barbell 2.

Figure 6:
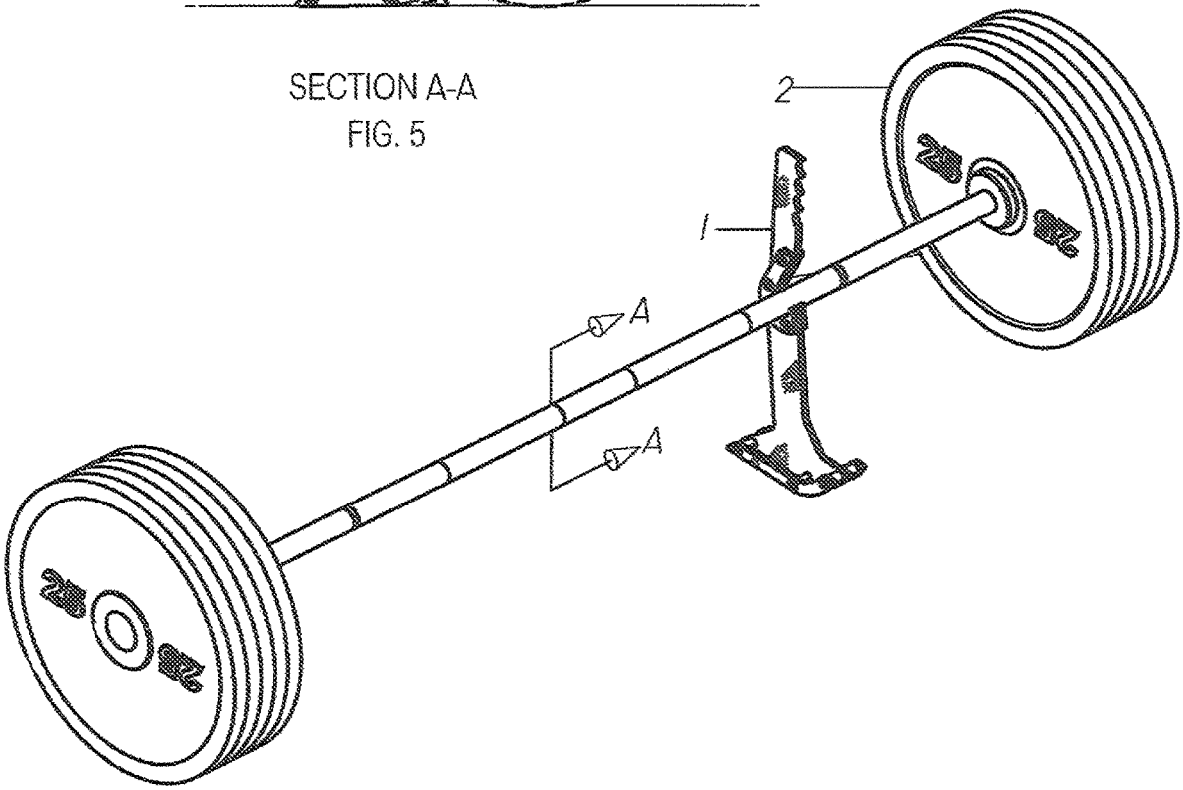
FIG. 6 showing a perspective view of the device holding an end of a barbell.
Figure 7:
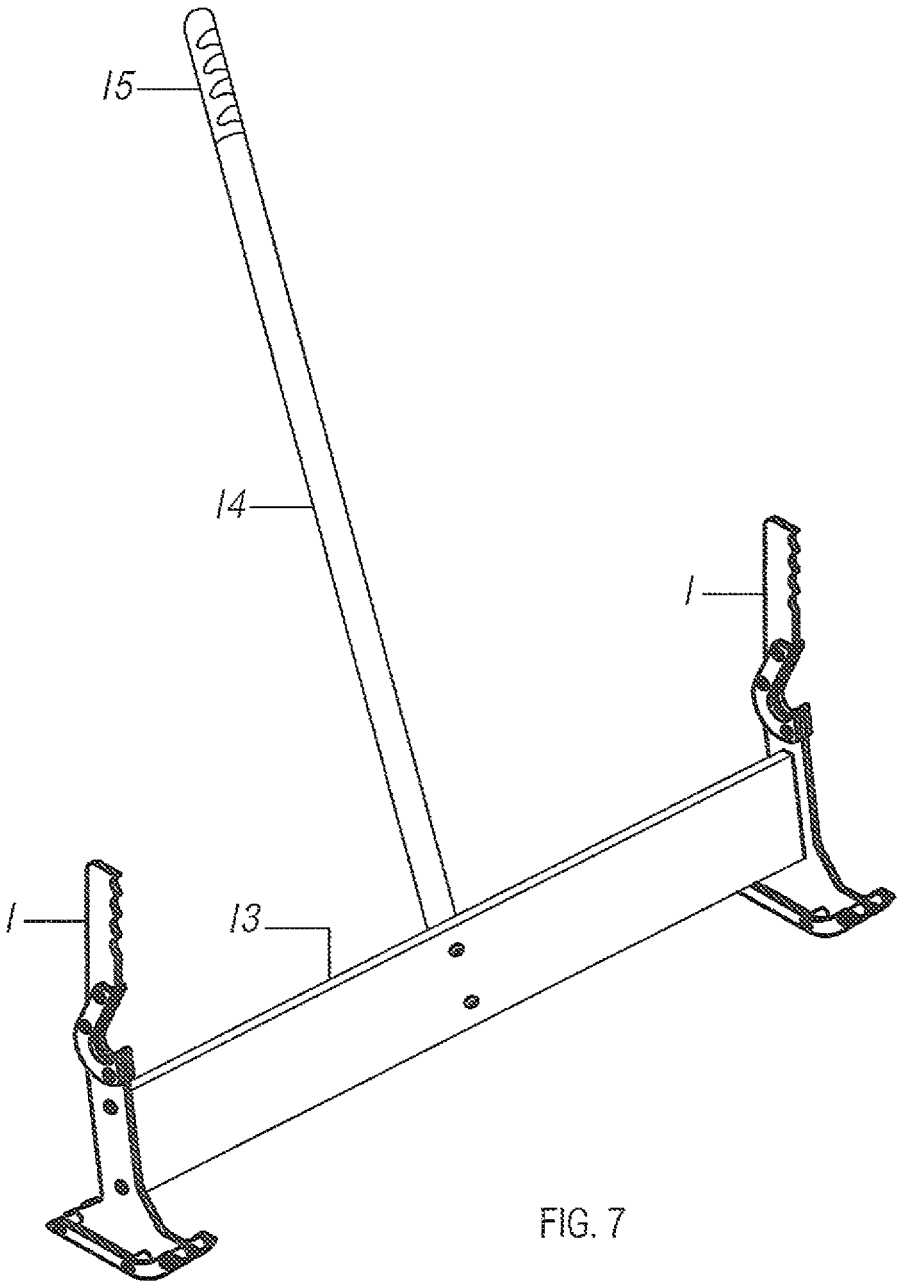
FIG. 7 showing another embodiment of the invention.

FIG. 6 showing a perspective view of invention 1 holding an end of barbell 2. FIG. 7 illustrating a perspective view of another embodiment of the invention having two of the invention 1*s* connected by means of a cross plate 13 and with pole 14 (made of a rigid material such as metal etc.) configured perpendicular to said cross plate 13's longitudinal axis. Said pole 14 (comprised of but not limited to a metal material) also having handgrip 15 comprised of a rubber material thereon.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention.

What is claimed is:

1. A barbell hand jack, comprising: two main plates connected by a cross plate with a pole configured to be perpendicular to the cross plate and extending from a longitudinal axis of the cross plate;

wherein a proximal portion of each of the two main plates having a slot configured to receive a barbell therein;

two outrigger plates connected on each side of the two main plates by screw rods, the two outrigger plates being rectangular on a heel end of the main plate and curved following a toe end of the main plate; and a hand grip disposed on a top end of each of the two main plates having finger grips.

2. The barbell hand jack of claim 1, wherein the slots comprise slot protectors.

3. The barbell hand jack of claim 1, wherein a foot end of each of the two main plates comprises the toe end having an upwardly-curved profile with teeth.

* * * * *